US008122949B2

(12) United States Patent
Cherewyk

(10) Patent No.: US 8,122,949 B2
(45) Date of Patent: Feb. 28, 2012

(54) TAPERED SLEEVE AND FRACTURING HEAD SYSTEM FOR PROTECTING A CONVEYANCE STRING

(75) Inventor: Bruce (Boris) P. Cherewyk, Calgary (CA)

(73) Assignee: Isolation Equipment Services Inc., Calgary (CA)

( * ) Notice: Subject to any disclaimer, the term of this patent is extended or adjusted under 35 U.S.C. 154(b) by 218 days.

(21) Appl. No.: 12/243,854

(22) Filed: Oct. 1, 2008

(65) Prior Publication Data

US 2009/0145597 A1 Jun. 11, 2009

Related U.S. Application Data

(60) Provisional application No. 61/012,732, filed on Dec. 10, 2007.

(51) Int. Cl.
*E21B 33/03* (2006.01)

(52) U.S. Cl. ..... 166/90.1; 166/75.15; 166/177.5

(58) Field of Classification Search ..... 166/90.1, 166/75.15, 95.1, 91.1, 177.5
See application file for complete search history.

(56) References Cited

U.S. PATENT DOCUMENTS 3,130,987 A * 4/1964 Johnson ..... 285/123.8
5,012,865 A 5/1991 McLeod
6,557,629 B2 5/2003 Wong et al.
6,817,423 B2 11/2004 Dallas
6,899,172 B2 5/2005 McLeod et al.
7,213,641 B2 5/2007 McGuire et al.
2003/0221838 A1 12/2003 Dallas
2009/0101411 A1* 4/2009 Hannegan et al. ..... 175/25

FOREIGN PATENT DOCUMENTS

CA 2388664 12/2003
CA 2486516 7/2005
CA 2492614 7/2006

* cited by examiner

*Primary Examiner* — Thomas Bomar
*Assistant Examiner* — Brad Harcourt
(74) *Attorney, Agent, or Firm* — Sean W Goodwin

(57) ABSTRACT

A tapered sleeve and fracturing head system for introducing fracturing fluid to a wellbore, while protecting a conveyance string from the erosive effects of the fracturing fluid is disclosed. A tapered sleeve has a top portion and a tapered downhole portion. The sleeve is fit to a main bore of a fracturing head by an upset at the top portion of the sleeve that engages a shoulder of the fracturing head. The sleeve intercepts, deflects and redirects introduced fracturing fluids downhole, preventing direct impingement of the fracturing fluid against the conveyance string. The main bore of the fracturing head may also be tapered at an angle substantial parallel to and along the length of the taper of the sleeve, to further improve the fluid dynamics of the fracturing fluid and further reduce the erosive effects of the fracturing fluid.

23 Claims, 7 Drawing Sheets

TAPERED SLEEVE AND FRACTURING HEAD SYSTEM FOR PROTECTING A CONVEYANCE STRING

CROSS-REFERENCE TO RELATED APPLICATION

This application is a regular application claiming priority of U.S. Provisional Patent Application Ser. No. 61/012,732 filed on Dec. 10, 2007, the entirety of which is incorporated herein by reference for all purposes.

FIELD OF THE INVENTION

The invention relates to improvements to a fracturing head. More particularly, a fracturing head having a tapered tubular sleeve for intercepting, deflecting, and redirecting fracturing fluid downhole, protecting a conveyance string from eroding and improving the fluid dynamics of the fracturing fluid inside the fracturing head.

BACKGROUND OF THE INVENTION

When completing wells that are drilled vertically, horizontally or kicked off horizontally (meaning first vertical then horizontal), several formations may be encountered. These multiple formations may be completed in one run, so as to produce fluids or gases from the multiple formations up the well to maximize the production of the several formations. To complete multiple formations in a single run, a conveyance string, such as coil tubing may be used. The coil tubing, having the appropriate downhole tools attached, such as perforating tools, would be inserted downhole to the lowest formation.

Typically, a downhole tool, such as a brazer jet, operatively connected to a conveyance string, such as coil tubing, is placed adjacent the lowest formation and is used to gain access to the formation. After gaining access to the lowest formation, the brazer jet is raised uphole of the lowest formation and the formation is stimulated or fractured by pumping fracturing fluids down the annular space between the conveyance string and the wellbore.

Upon completing stimulation of the lowest formation, the coil tubing, and thus the downhole tool, is positioned to the next formation or interval of interest and the process repeated.

Similarly, other apparatus could extend though a fracturing head which are vulnerable to introduced fracturing fluids.

Fracturing fluids are typically introduced into the well from the surface through a multi-port fracturing head. The multi-port fracturing heads may have either angled side fluid ports or right angled side fluid ports.

Current multi-port fracturing heads or fracheads, have a main bore which is in fluid communication with a wellhead, the wellhead having a bore of the production tubing or conveyance string extending downhole. The frachead includes side ports which can be angled downwardly or directed at right angles to the main bore. Typically the side ports are diametrically opposed, directing the fracturing fluid at each other and colliding in the main bore.

To reduce the overall weight of the fracturing head, and the compressive load placed on a wellhead, the size of the fracturing head is usually reduced. Typically, fracturing heads with right angled side ports are shorter in height than fracturing heads with angled side ports. The shorter height reduces the overall size of the fracturing head and thus reduces the overall weight and load placed on the wellhead by the fracturing head. Further, the shortened height of the fracturing head allows the entire wellhead assembly to be significantly lower to the ground, improving accessibility, and safety for operational purposes.

However, regardless of the angle of the side ports, fracturing fluid entering the frachead is known to cause significant erosive damage to the internal surfaces of the fracturing head. The abrasive nature of proppant in the fracturing fluid coupled with the velocity and fluid dynamics of the fracturing fluid causes erosion of the internal surfaces of the fracturing head and the conveyance string, such as coil tubing. This is especially evident at high pumping rates.

In circumstances where the main bore of the frachead includes apparatus passing through the main bore, the fracturing fluid would directly impinge the apparatus. Apparatus passing or extending through the frachead include tubular and conveyance strings, such as coil tubing, wireline, E-line, slick line and the like. Herein, such apparatus will be referred to as conveyance string.

Higher pumping rates result in higher velocities of the fracturing fluid traveling inside the fracturing head, thereby increasing the erosive damage to the conveyance string. Completions with fluids which vary from low erosion gels to high erosion slick water or straight water (combined with a sand proppant and nitrogen or carbon dioxide) for the fracturing fluid create much higher erosive damage.

US Patent Application Publication No. 2003/0221838 to Dallas discloses a blast joint to protect a coil tubing string from erosion when abrasive fluids are pumped through the fracturing head. However, the blast joint taught by Dallas only protects the coil tubing from direct impingement of the fracturing fluid and does not deflect and redirect fracturing fluid into a wellbore.

It is also known to introduce fracturing fluids through fracturing heads with angled side ports, however these fracturing heads are necessarily taller, significantly larger and heavier. Using embodiments of this invention, by intercepting, deflecting and redirecting the fracturing fluid stream within a fracturing head and minimizing fluid velocities, the overall size of the fracturing head is minimized. A smaller fracturing head requires less material to manufacture, is lighter and therefore is easier, more economical and safer to operate. Using right angle side ports, the overall profile of the fracturing head is reduced. The low profile also eliminates the need costs associated therewith for a man basket, additional scaffolds and third party crane units typically required for larger fracturing heads having angled side ports.

SUMMARY OF THE INVENTION

Apparatus and system is provided for receiving fracturing fluids entering a fracturing head from side ports and re-directing them downhole for protecting a conveyance string extending therethrough.

Generally, a tubular tapered sleeve is fit to the fracturing head, the sleeve having an inwardly and downwardly angled tapered outer surface and a bore adapted to pass a conveyance string therethrough. The sleeve has a top portion adapted to fit a main bore of the fracturing head and a downhole portion extending sufficiently downwardly and adapted to be at least juxtaposed across from the side ports. At least the downhole portion is tapered. To retain the sleeve within the main bore of the fracturing head, the top portion of the sleeve can have an upset that is fit to a shoulder in the main bore for limiting downhole movement of the sleeve through the main bore. The sleeve could itself be of erosion resistance material or the tapered outer surface could be coated or hardened to increase its wear resistance.

Further advantage is gained by synergistic system between the sleeve and an embodiment of the fracturing head. Such a system comprises a fracturing head having one or more side ports that are in fluid communication with a main bore extending therethrough. The tapered tubular sleeve is fit to the main bore from a top end of the fracturing head, and the downhole tapered portion extends downhole to a position below the one or more side ports. The main bore uphole of the side ports corresponds to the top portion for supporting the tapered sleeve therein. The main bore above the side ports can be formed with a shoulder and the tapered sleeve with an annular upset which engages the shoulder for ensuring support of the tapered sleeve.

The main bore can be tapered to correspond with the tapered sleeve, thereby maximizing annular cross-sectional area for the fracturing fluid therethrough and improve fluid dynamics thereof. The main body of the fracturing head is angled or tapered to be substantially parallel to and along the length of the taper or angle of the tapered sleeve thus minimizing or eliminating fracturing fluid acceleration as the fracturing fluid travels through the annular space formed between the outer surface of tapered sleeve and the main bore of the fracturing head. The stabilized fracturing fluid travels down into the wellbore without causing abrasive damage to the conveyance string.

In a broad aspect of the invention, a fracturing system, for introducing fracturing fluid to a wellbore through a conveyance string is disclosed. The system has a fracturing head with a main bore extending therethrough. The fracturing head further has one or more side fluid ports spaced around the fracturing head, in fluid communication with a tapered downhole end of the main bore for introducing fracturing fluid into the fracturing head.

The system further has a tapered tubular sleeve, the sleeve having a sleeve bore for receiving the conveyance string, and an outer surface. The outer surface has a top portion fit to an uphole end of the fracturing head's main bore, and a tapered downhole portion extending downwardly and tapering radially inwardly, downhole from the top portion and at least juxtaposed from the one or more side fluid ports for redirecting fracturing fluid down the wellbore.

In another aspect, the tapered downhole end of the main bore is substantially parallel to and along the tapered downhole portion of the outer surface of the sleeve.

In FIGS. 1-3, 5A, 5B, and 7, various bolt holes and bolt recesses are shown. Not all holes and recesses are shown and corresponding fasteners have all been omitted.

DETAILED DESCRIPTION OF THE INVENTION

Figure 1:
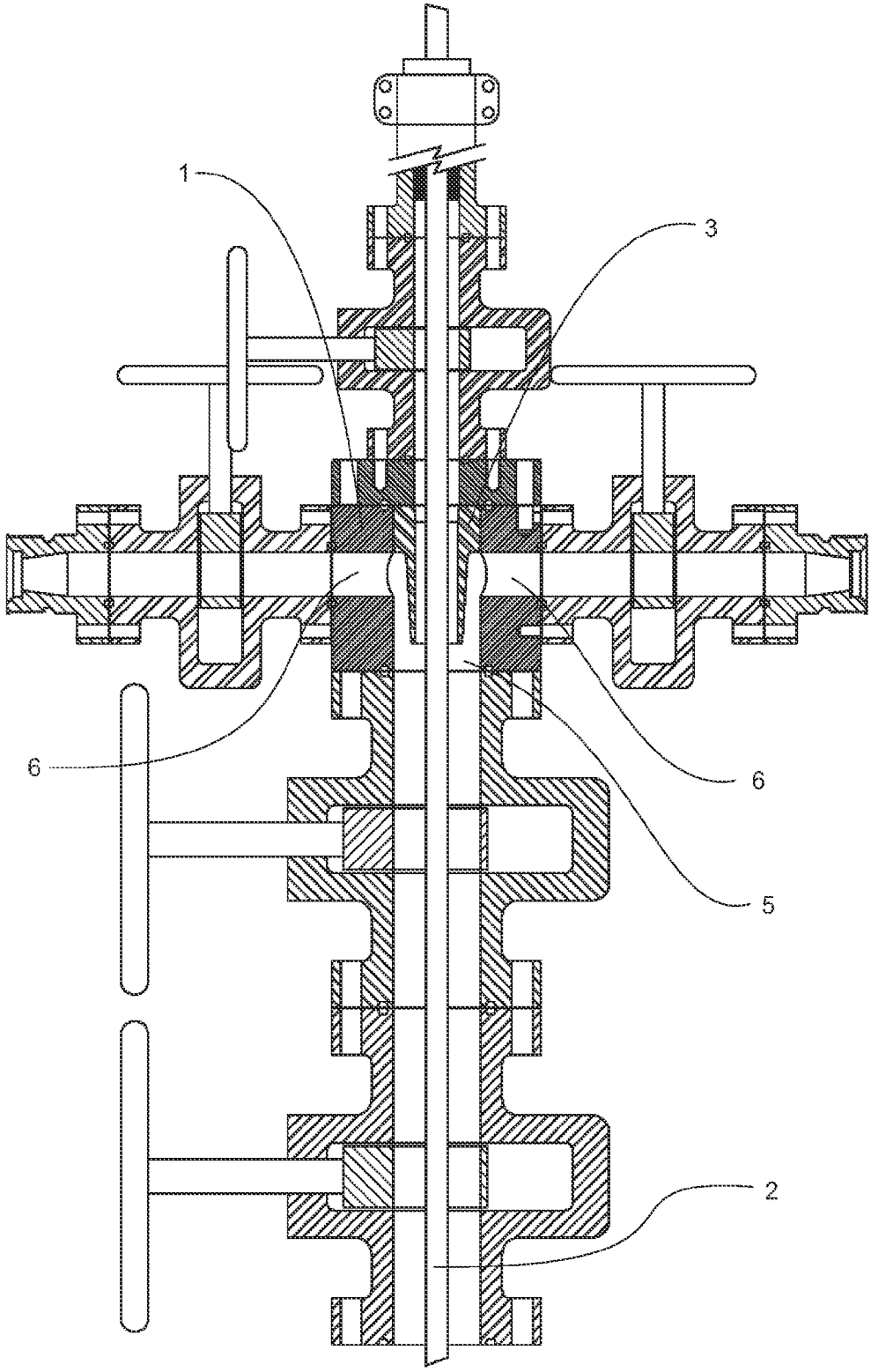
FIG. 1 is a cross-sectional view of an embodiment of the present invention illustrating a low-profile fracturing head having opposing and right-angled side fluid ports.

With reference to FIG. 1, a fracturing head 1 is shown fit with a tapered deflecting sleeve 3. The fracturing head 1 has a main bore 5 which receives fracturing fluid (not shown) introduced from side ports 6. The tapered sleeve intercepts the fracturing fluid, deflects and redirects the fluid downhole to a wellbore. The tapered sleeve has a sleeve bore adapted to receive a conveyance string, such as coiled tubing. By intercepting the incoming fracturing fluid, deflecting and re-directing it downhole, the tapered sleeve 3 prevents direct impingement of the fracturing fluid with the conveyance string. The fracturing fluid, which could include proppants, is deflected and redirected to avoid erosive effects of the fracturing fluid. The general deflection and redirection of the fracturing fluid downhole reduces the velocity of the fracturing fluid, as the fracturing fluid passes by the conveyance string 2, to further mitigate the erosive effects of the proppants in the fracturing fluid.

Figure 2:
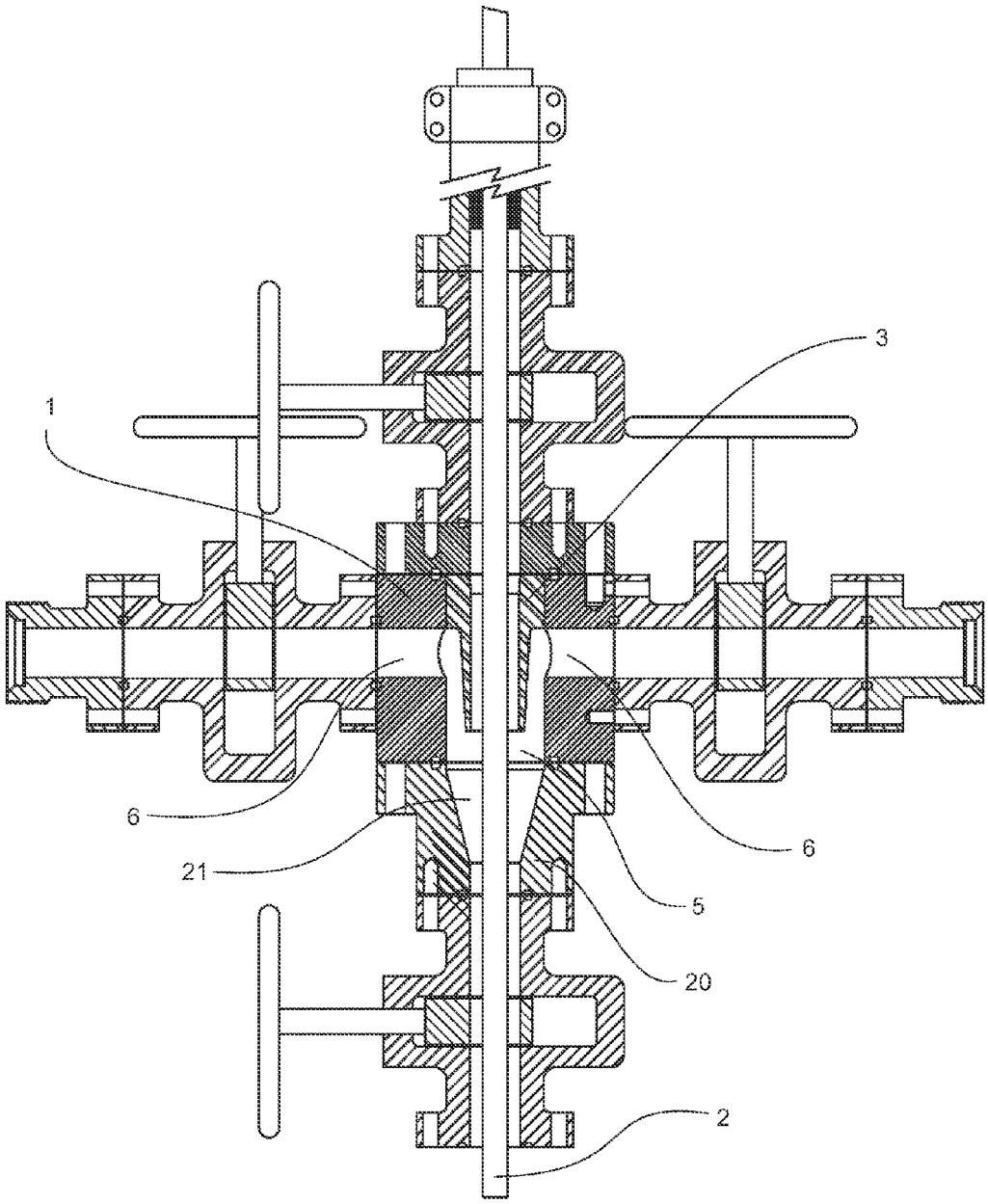
FIG. 2 is a cross-sectional view of an embodiment of the present invention illustrating a low-profile fracturing head fit to a tapered adapter.
Figure 3:
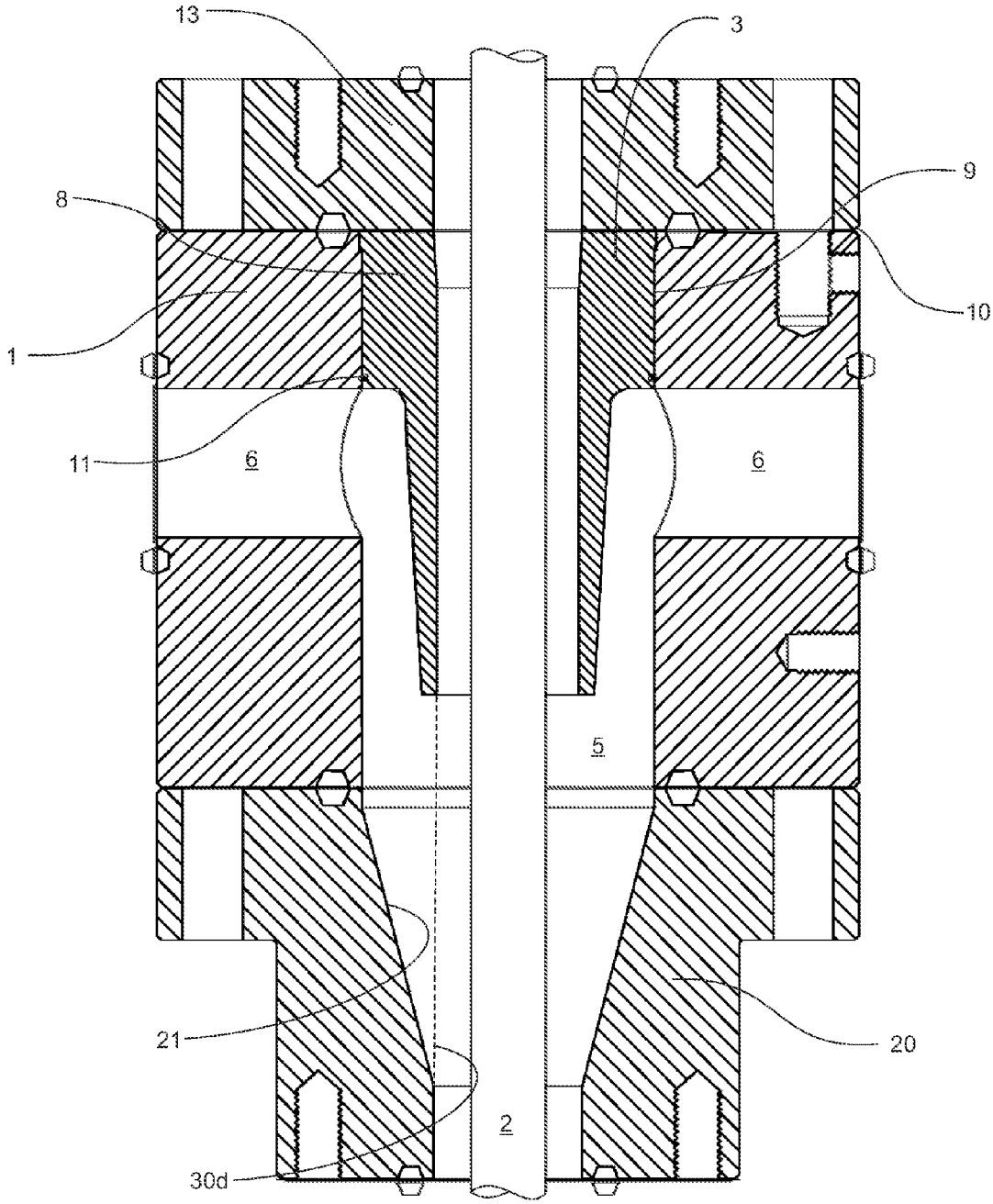
FIG. 3 is a cross-sectional view of the fracturing head and tapered adapter of FIG. 2, the fracturing head having a regular straight main bore.

With reference to FIGS. 2 and 3, in another embodiment, a fracturing head 1, having a tapered deflecting sleeve 3, is shown fit to a downhole adaptor 20 to reduce the bore diameter. The adapter 20 has a tapered bore 21 for reducing the fracturing head bore 5 to a reduced bore 30*d* of the wellbore, the reduced bore 30*b* being about that of the sleeve bore 30.

Figure 4:
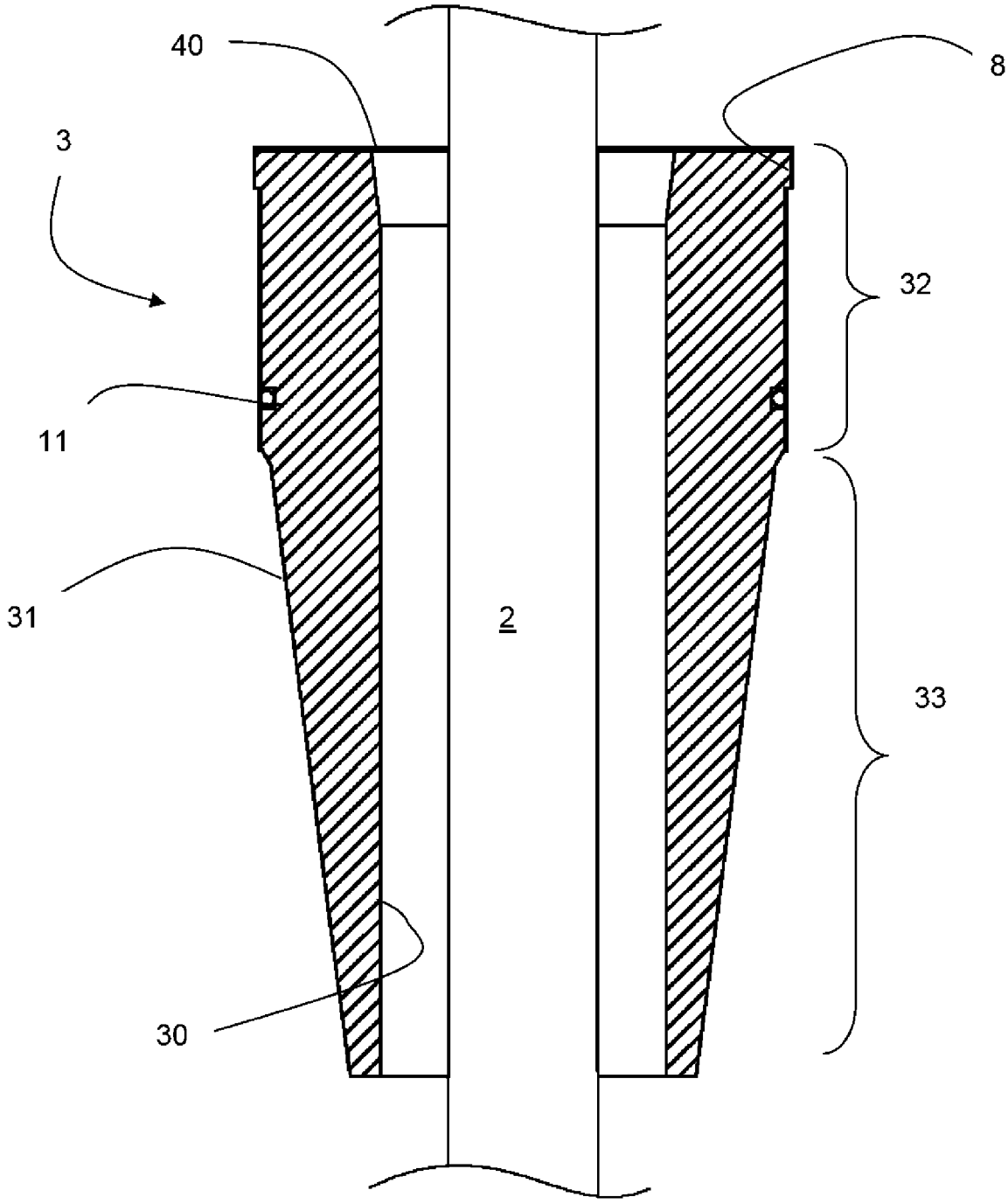
FIG. 4 is cross-sectional view of side elevation of an embodiment of a tapered deflecting sleeve having a straight sleeve bore.

With reference to FIG. 4, a tapered deflecting sleeve 3 has a sleeve bore 30 for receiving a conveyance string 2, and an outer surface 31. The outer surface 31 has a top portion 32 and a tapered downhole portion 33. In one embodiment, the top portion 32 has an upset 8 at an uphole end of the top portion 32 of the sleeve 3.

Figure 5B:
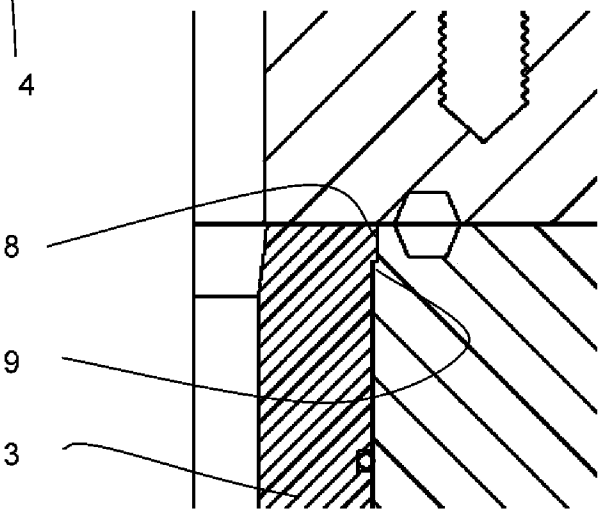
FIG. 5B is a close up view of an upset and shoulder.
Figure 5A:
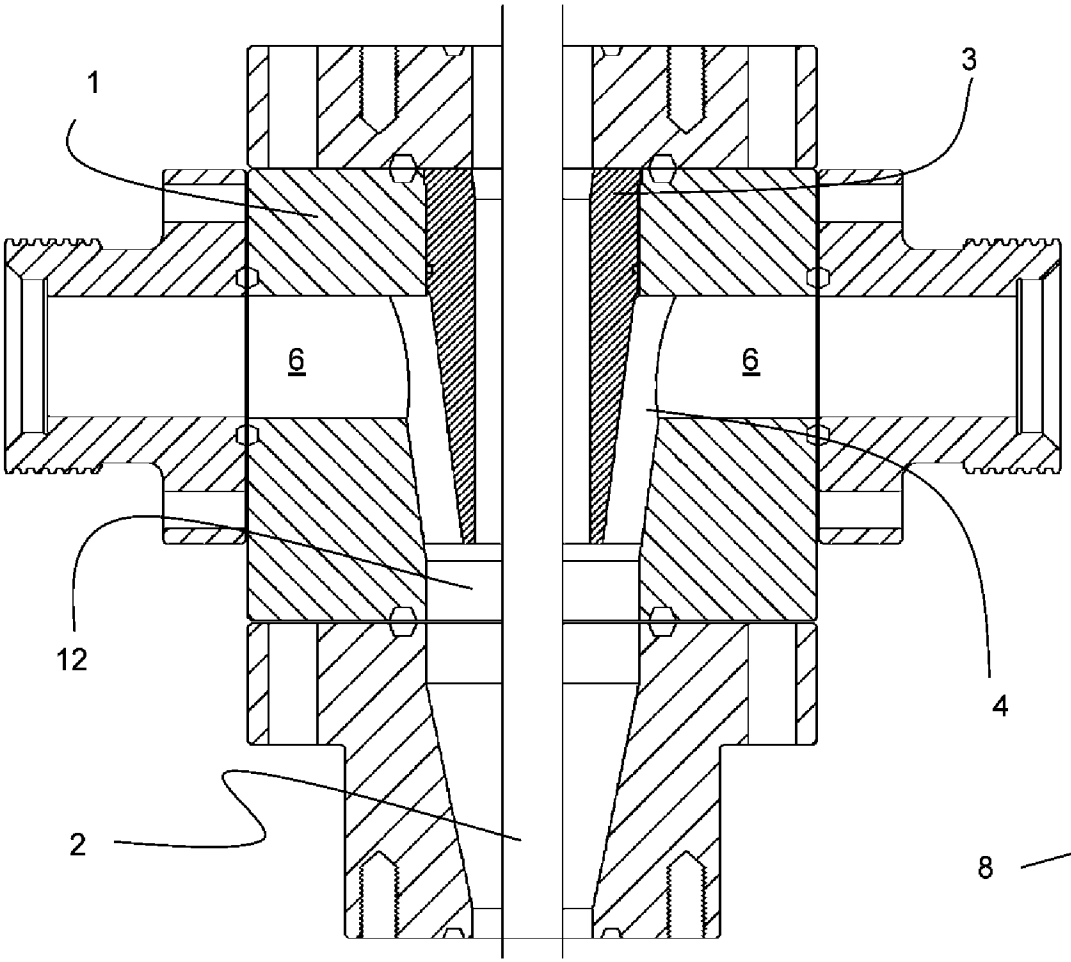
FIG. 5A is a cross-sectional view of an embodiment of the system illustrating a tapered deflecting sleeve within a fracturing head having a tapered main bore.

With reference also to FIGS. 3, 5A, and 5B the upset 8 is adapted for engaging a shoulder 9 at an uphole portion of the fracturing head's main bore 5, preventing any downhole movement of the sleeve 3. The top portion 32 further has an annular sealing element 11 between the main bore 5 and the outer surface 31 for sealing against the uphole movement of fracturing fluids.

The tapered downhole portion 33 extends downhole and is at least juxtaposed from the one or more side fluid ports 6 for intercepting fracturing fluid. The tapered downhole portion 33 is of sufficient length to provide a protective sleeve for the conveyance string 2 such that it intercepts the flow of fracturing fluid, redirecting the fracturing fluid downhole, and typically terminates within the fracturing head 1, at a point downhole from the side ports 6, such that the deflecting sleeve 3 does not extend beyond the main bore 5 of the fracturing head 1. The outer surface 31 of the tapered downhole portion 33 progressively narrows radially inward in the downhole direction, an uphole diameter being greater than a downhole diameter.

The fracturing head 1 has diametrically opposing right angle side ports 6 and a deflecting sleeve 3 for protecting the conveyance string 2 is illustrated. The angled or tapered sleeve 3 envelops the conveyance string 2, such as coil tubing, running downhole through the fracturing head 1. The deflecting sleeve 3 is positioned within the fracturing head 1 to envelop that portion of the conveyance string 2 that is in the direct path of fracturing fluid entering the main bore 5 from the side ports 6. The deflecting sleeve 3 provides a first layer of physical protection to this portion of the conveyance string 2 by intercepting fracturing fluid that would otherwise directly impinge that portion of the conveyance string 2 adjacent the side ports 6, causing excessive erosion.

The tapered deflecting sleeve 3 further provides an additional layer of physical protection by aiding in deflecting and redirecting the entering fracturing fluid downhole, reducing any erosive effects of the fracturing fluid to a downhole portion of the conveyance string 2 not directly enveloped by the deflecting sleeve 3. By deflecting the direction of the entering fracturing fluid downhole, the abrasive flow of the proppants in the fracturing fluid imparts less energy on the conveyance string 2, thereby reducing the erosive effects of the abrasive fracturing fluid.

The tapered deflecting sleeve 3 has an inner diameter sufficiently large enough to allow the conveyance string 2, such as coil tubing, to pass therethrough. The sleeve 3 could be of erosion resistance material, or may be hardened with tungsten or a diamond coating to increase its wear resistant properties. One suitable coating is HVOF coatings by Hyperion Technologies, Calgary, Canada, providing upwards of 90 Rockwell hardness. The HVOF coating optionally replaces hexavalent chrome coatings.

Best shown is FIG. 5B, the deflecting sleeve 3 has an annular upset 8 adapted to engage an annular shoulder 9 formed at an uphole portion of the main bore 5. The upset 8 and shoulder 9 causes the deflector sleeve 3 to firmly position within the fracturing head 1, concentrically aligned within the main bore 5.

The upset 8 and shoulder 9 method of connection avoids conventional threading connections between the deflecting sleeve 3 and the fracturing head 1, as threaded connections may be vulnerable to the effects of hardening processes. Further, the upset 8 and shoulder 9 method of connection allows for quick and easy removal of the deflecting sleeve 3, when removal of the sleeve 3 is required.

A top end 40 of the top portion 32 can be flush with an uphole flanged interface 10 formed between the fracturing head 1 and generic upper equipment. An annular sealing element 11 can be fit about the top portion 32 of the sleeve 3, between the main bore 5 and the outer surface 31, preventing the upward movement of fracturing fluid to the uphole flanged interface 10.

Figure 7:
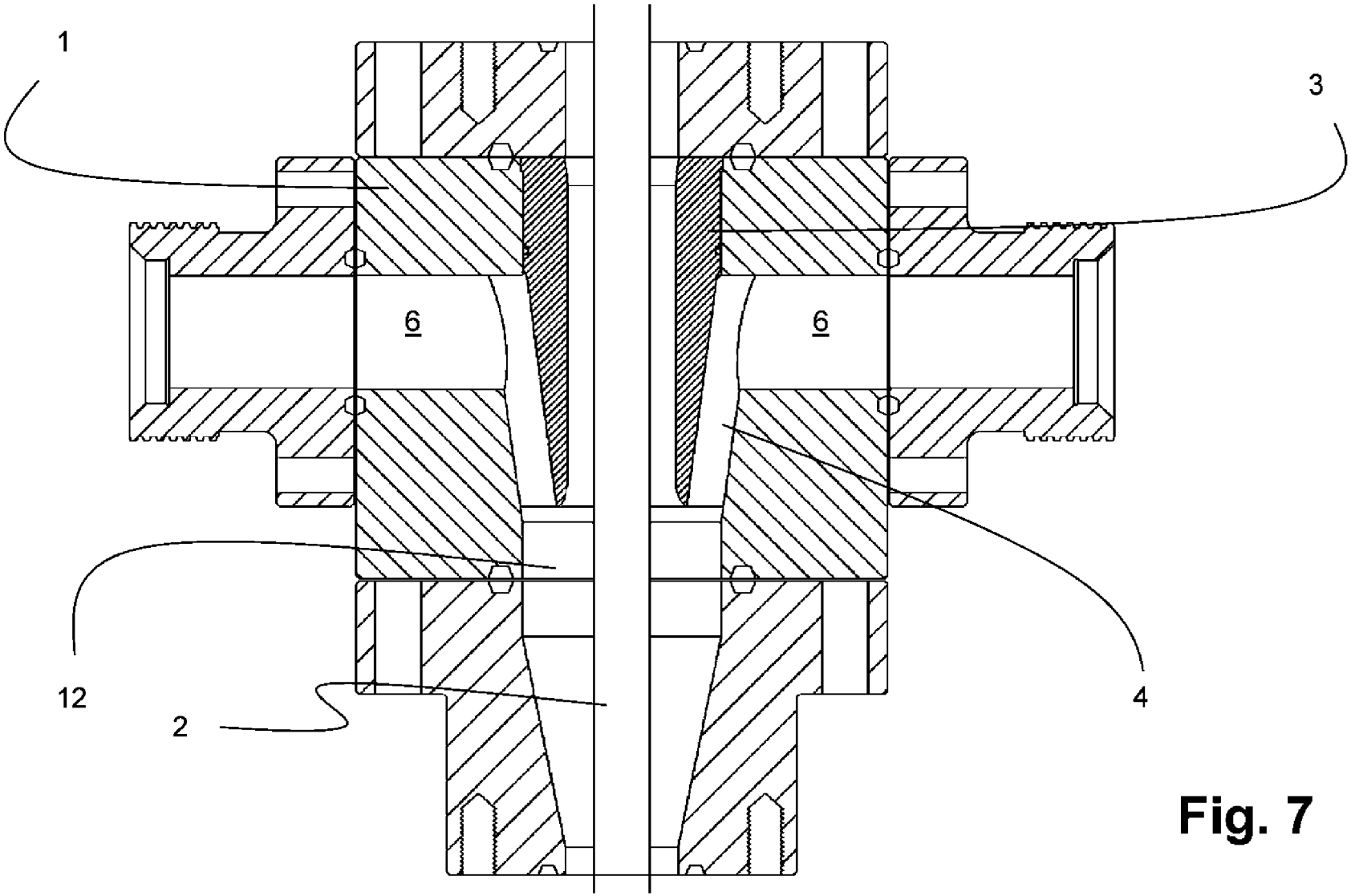
FIG. 7 is cross-sectional view of an embodiment of the present invention illustrating a tapered deflecting sleeve within a fracturing head having a tapered main bore, the deflecting sleeve having a flared sleeve bore at a distal end.

In a system embodiment, as shown in FIGS. 5A and 7, the fracturing head 1 can have a tapered main bore 12, increasing the annular cross-section 4 of the main bore 12. The increased annular cross-section 4 further decreases the velocity of the fracturing fluid as the fracturing fluid enters the main bore 12 from the side ports 6. This further reduction of the velocity of the fracturing fluid cooperatively improves the fluid dynamics of the passing fracturing fluid, even further reducing the erosive effects of the fracturing fluid on the conveyance string 2.

The fracturing head 1 comprises a tapered main bore 12 to improve the fluid dynamics of the fracturing fluid flowing downhole. The taper or angle of the main bore 12 is substantially parallel with the taper or angle of the tapered downhole portion 33 deflecting sleeve 3. The taper extends from about the side ports 6 to about a downhole termination of the sleeve 3.

The tapered main bore 12 increases the annular cross-section 4 of the main bore 12. The increased annular cross-section 4 further decreases the velocity of the fracturing fluid as the fracturing fluid enters the main bore 12 from the side ports 6. This further reduction of the velocity of the fracturing fluid cooperatively improves the fluid dynamics of the passing fracturing fluid, even further reducing the erosive effects of the fracturing fluid on the conveyance string 2.

For example, using a nominal 4" side port, the cross-sectional flow area is about 13 sq. inches. For a fracturing fluid flow rate of about 1 cu. meter/minute, the velocity is about 6.5 ft/sec. Using a tapered main bore and a tapered deflecting sleeve, the annular cross-sectional area about the deflecting sleeve increases to about 32 sq. inches, reducing the velocity advantageously to about 3 ft/sec. As the fluid flow passes the downhole portion of the deflecting sleeve, the fluid enters a larger annular area. For a conveyance string 2 of 2-inch coiled tubing, the remaining annular cross-sectional area increases to about 36 sq. inches for a further reduction in fluid velocity to about 2.3 ft/sec.

Figure 6:
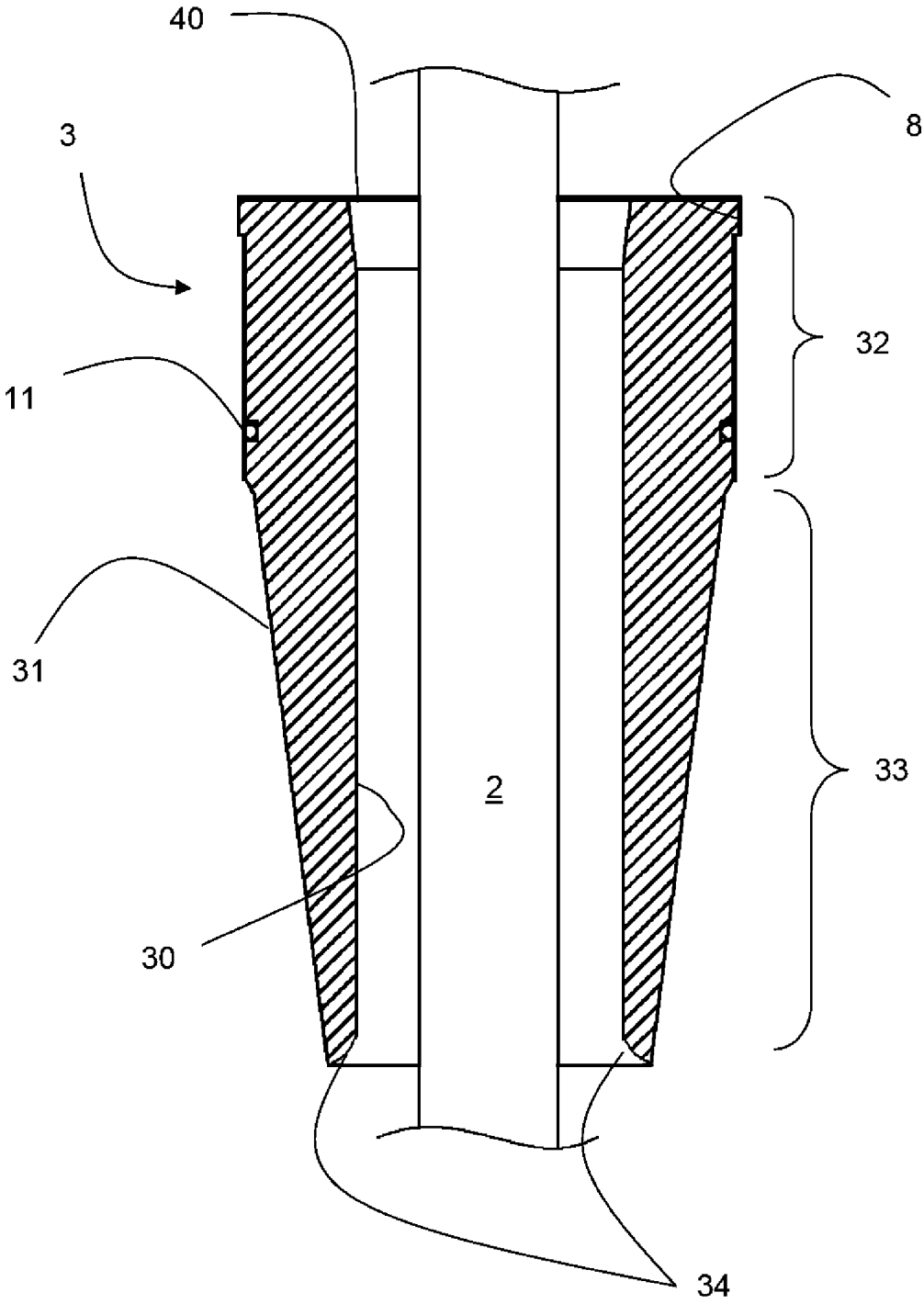
FIG. 6 is a cross-sectional view of side elevation of an embodiment of a tapered deflecting sleeve with radially outward flares at a distal end of the sleeve bore.

With reference to FIGS. 6 and 7, in another embodiment, a tapered deflecting sleeve 3 is shown having a sleeve bore 30 with radially outward flares 34 at a distal end to allow unimpeded upward movement of the conveyance string 2 and attached downhole tools.

I claim:

1. A fracturing system, for improving fluid dynamics of incoming fracturing fluid introduced to a wellbore and protecting a conveyance string passing therethrough from erosive effects of the incoming fracturing fluid, the system comprising:

a fracturing head having a main bore extending therethrough, and having two or more side fluid ports spaced around the main bore, the main bore receiving the incoming fracturing fluid therein; and a wear resistant, tubular sleeve having a sleeve bore for receiving the conveyance string therethrough, a top portion fit to the main bore uphole of the two or more side fluid ports, and a downhole portion extending downwardly to below the two or more side fluid ports and forming an annular space between the downhole portion and the main bore, an annular cross-sectional area of the annular space increasing adjacent the two or more side fluid ports for decreasing a velocity of the incoming fracturing fluid, wherein the downhole portion intercepts the incoming fracturing fluid and redirects the fracturing fluid down the increased annular cross-sectional area and to the wellbore.

2. The fracturing system of claim 1 wherein:

the top portion further comprises an annular upset for engaging an annular shoulder of the main bore uphole of the two or more side fluid ports for positioning the tubular sleeve within the fracturing head.

3. The fracturing system of claim 1, wherein the sleeve bore further comprises a downhole end flaredradially outwardly.

4. The fracturing system of claim 1 further comprising an annular sealing element fit between the top portion of the tubular sleeve and the main bore for sealing the main bore uphole of the two or more side fluid ports.

5. The fracturing system of claim 1 wherein the downhole portion of the sleeve tapers radially inwardly downhole for increasing an annular cross-sectional area of the annular space.

6. The fracturing system of claim 1 wherein the main bore has a tapered downhole end below the two or more side fluid ports for increasing an annular cross-sectional area of the annular space.

7. The fracturing system of claim 6, wherein the downhole portion of the tubular sleeve further comprises a taper which is substantially parallel to a taper of the tapered downhole end of the main bore.

8. The fracturing system of claim 1 wherein the downhole portion of the sleeve tapers radially inwardly; and the main bore has a tapered downhole end below the two or more side fluid ports for increasing an annular cross-sectional area of the annular space.

9. The fracturing system of claim 1 further comprising a downhole adapter between the fracturing head and the wellbore, the downhole adapter having a tapered bore to reduce the main bore diameter of the fracturing head to that of the wellbore.

10. The fracturing system of claim 9 wherein the sleeve bore is about the diameter of wellbore.

11. The fracturing system of claim 1 wherein two or more side fluid ports are right angled to the main bore.

12. The fracturing system of claim 1 wherein the sleeve bore further comprises a downhole end flared radially outwardly.

13. The fracturing system of claim 1 wherein the top portion further comprises an annular upset for engaging an annular shoulder of the main bore uphole of the two or more side fluid ports for positioning the tubular sleeve within the fracturing head.

14. The fracturing system of claim 13 further comprising an annular sealing element fit between the top portion of the sleeve and the main bore for sealing the main bore uphole of the two or more side fluid ports.

15. A wear resistant, tubular sleeve for fitment in a main bore of a fracturing head having two or more side fluid ports for improving fluid dynamics of incoming fracturing fluid being introduced to the main bore through two or more side fluid ports, and protecting a conveyance string passing through the main bore from erosive effects of the incoming fracturing fluid, the sleeve comprising:

a sleeve bore for receiving the conveyance string therethrough;

a top portion for fitting the tubular sleeve to the main bore uphole of the two or more side fluid ports; and a downhole portion extending downwardly from the top portion to below the two or more side fluid ports, the downhole portion tapering radially inwardly for increasing an annular cross-sectional area of the main bore adjacent the two or more side fluid ports for decreasing a velocity of the incoming fracturing fluid entering the main bore through the two or more side fluid ports, wherein the downhole portion intercepts the incoming fracturing fluid and redirects the fracturing fluid down the increased cross-sectional area.

16. The tubular sleeve of claim 15, wherein the top portion further comprises an annular upset, for engaging an annular shoulder of the main bore uphole of the two or more side fluid ports for positioning the tubular sleeve within the fracturing head.

17. The tubular sleeve of claim 15, wherein the top portion further comprises an annular sealing element for sealing the tubular sleeve to the main bore uphole of the two or more side fluid ports.

18. A method for protecting a conveyance string from fracturing fluids introduced to a wellbore through a fracturing head, the conveyance string passing through the wellbore, the method comprising:

providing the fracturing head with a main bore extending therethrough and two or more side fluid ports spaced about the main bore for introducing the fracturing fluids;

providing a downhole adapter having a tapered bore to reduce a main bore diameter of the fracturing head to that of the wellbore;

fitting the downhole adapter to the wellbore and the fracturing head to the downhole adapter, the main bore in fluid communication with the adapter's tapered bore and the adapter's tapered bore in communication with the wellbore;

fitting the fracturing head to the wellbore with the main bore in fluid communication therewith;

fitting a wear resistant sleeve to the main bore of the fracturing head for intercepting the fracturing fluids from the two or more side fluid ports, the sleeve having a sleeve bore for passing the conveyance string therethrough and through the wellbore; and forming an annular space between a downhole portion of the wear resistant sleeve and the main bore and having a cross-sectional area for reducing the velocity of the fracturing fluid introduced from the two or more side ports.

19. The method of claim 18 wherein sleeve has a top end and a downhole portion, the fitting of the sleeve to the fracturing head further comprising:

fitting the top end of the sleeve to the main bore of the fracturing head above the two or more side ports with the downhole portion extending downwardly to below the two or more side fluid ports for redirecting the introduced fracturing fluid downhole to the wellbore.

20. The method of claim 18 wherein the forming of the annular space for reducing the velocity of the fracturing fluid further comprises:

fitting a wear resistant sleeve having a downhole portion of the sleeve tapering radially inwardly from about the two or more side fluid ports to about a downhole point adjacent from a downhole termination of the sleeve.

21. The method of claim 18 wherein the forming of the annular space for reducing the velocity of the fracturing fluid further comprises:

tapering the main bore from about the two or more side fluid ports to about a downhole point adjacent from a downhole termination of the sleeve.

22. The method of claim 21 wherein increasing a cross-sectional area of the main bore further comprises fitting a wear resistant sleeve having a downhole portion of the sleeve tapering radially inwardly from about the two or more side fluid ports to about a downhole point adjacent from a downhole termination of the sleeve.

23. The method of claim 18 wherein the fitting of the wear resistant sleeve to the main bore of the fracturing head further comprises:

fitting the wear resistant sleeve, having a sleeve bore about that of the wellbore.

* * * * *